US005359797A

United States Patent [19]

Williamson

[11] Patent Number: 5,359,797

[45] Date of Patent: Nov. 1, 1994

[54] SKI POLE TRAIL MAP HOLDER

[76] Inventor: Roger L. Williamson, 6821 Avenida de Santiago, Anaheim, Calif. 92807

[21] Appl. No.: 212,318

[22] Filed: Mar. 14, 1994

Related U.S. Application Data

[63] Continuation of Ser. No. 886,985, May 21, 1992, abandoned.

[51] Int. Cl.[5] ..... G09F 11/18

[52] U.S. Cl. ..... 280/816; 280/819; 40/517; 40/904; 40/600

[58] Field of Search ..... 40/517, 317, 660, 334, 40/905, 904; 224/277; 280/819

[56] References Cited

U.S. PATENT DOCUMENTS

| | | | |
|---|---|---|---|
| 490,722 | 1/1893 | Pugh . | |
| 495,978 | 4/1893 | Klaff . | |
| 498,187 | 5/1893 | Pugh . | |
| 596,873 | 1/1898 | Guy . | |
| 764,301 | 7/1904 | Osborn . | |
| 764,997 | 7/1904 | Finch . | |
| 772,408 | 10/1904 | Ely . | |
| 991,608 | 5/1911 | Day | 40/317 |
| 1,298,739 | 4/1919 | Langford | 40/517 |
| 1,364,223 | 1/1921 | Venard | 40/517 |
| 1,576,028 | 3/1926 | Bowen . | |
| 1,710,555 | 4/1929 | Tascarella . | |
| 1,796,243 | 3/1931 | Coughlin . | |
| 2,041,334 | 5/1936 | Hage . | |
| 2,111,362 | 3/1938 | Fisher . | |
| 2,173,188 | 9/1939 | Van Dersal . | |
| 2,251,579 | 8/1941 | Rugg . | |
| 2,473,158 | 6/1949 | Luenens, Jr. . | |
| 2,563,580 | 8/1951 | Clark . | |
| 2,610,420 | 9/1952 | Kohl . | |
| 2,821,798 | 2/1958 | Baker . | |
| 3,215,453 | 11/1965 | Malcom, Jr. . | |
| 3,533,177 | 10/1970 | Tott . | |
| 3,553,864 | 1/1971 | Karlyn et al. . | |
| 3,810,647 | 5/1974 | Martchenke . | |
| 3,884,351 | 5/1975 | James | 40/517 |
| 4,023,817 | 5/1977 | Lah et al. . | |
| 4,082,302 | 4/1978 | Albrecht . | |
| 4,415,106 | 11/1983 | Connell et al. . | |
| 4,731,766 | 3/1988 | Bunyea . | |
| 4,762,340 | 8/1988 | Addison, Jr. . | |
| 4,930,810 | 6/1990 | Addison, Jr. . | |

FOREIGN PATENT DOCUMENTS

| | | | |
|---|---|---|---|
| 2459733 | 7/1976 | Germany | 40/517 |
| 11163 | of 1901 | United Kingdom | 40/517 |

OTHER PUBLICATIONS

12 Photographs of Pole Cat TM product.

*Primary Examiner*—Kenneth J. Dorner
*Assistant Examiner*—Cassandra Davis
*Attorney, Agent, or Firm*—Knobbe, Martens, Olson & Bear

[57] ABSTRACT

A ski area trail map holder is provided for use with a ski pole. In one form, the holder comprises a tubular housing having a spring biased roller therein. The housing is attachable to the ski pole at any point along the pole. The ski area trail map is releasably secured to a map cover which is extendable from a retracted position in which it is rolled on the roller, to an extended position in which it is outside of the housing. The map cover comprises two transparent sheets, each of which is attached at one end to the roller and each of which has a free end located outside of the housing. A locking mechanism is provided for securing the map cover and/or map in an extended position. In a second embodiment, the ski pole itself acts as the outer housing for the map holder.

9 Claims, 5 Drawing Sheets

FIG. 1
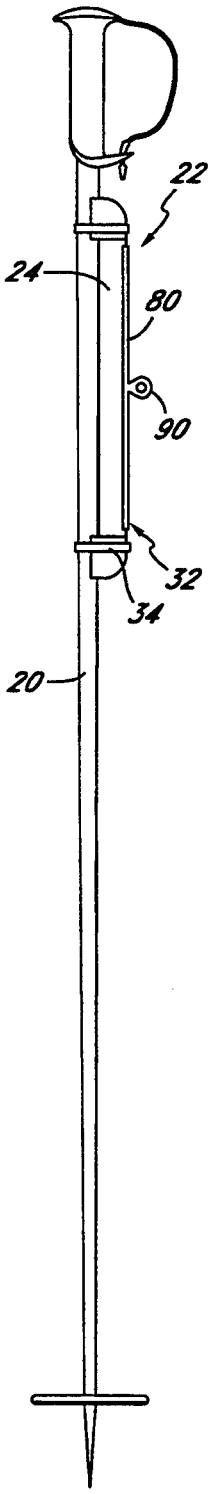
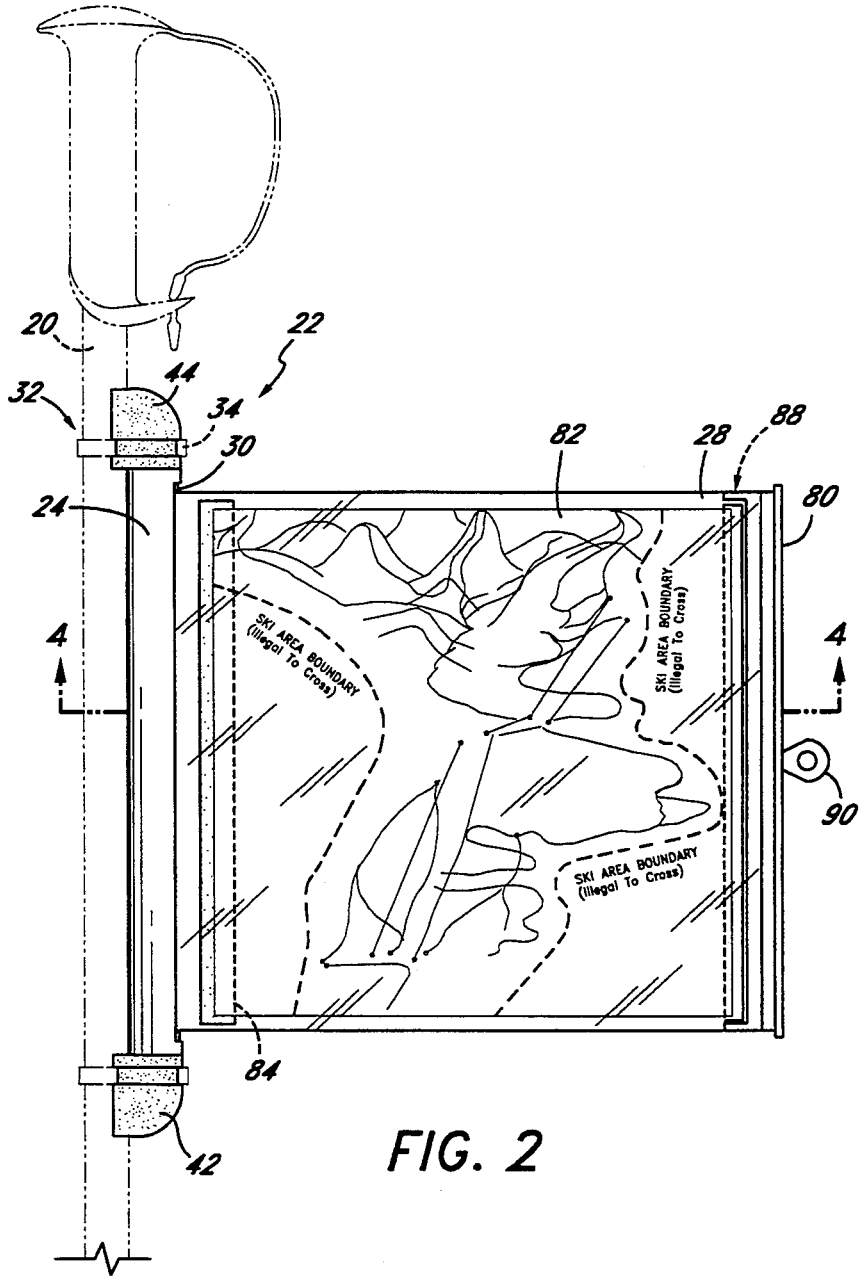
FIG. 2

SKI POLE TRAIL MAP HOLDER

This application is a continuation of application Ser. No. 07/886,985, filed May 21, 1992, now abandoned.

FIELD OF THE INVENTION

The present invention relates to a map holder. More specifically, the invention relates to a ski area trail map holder for use with a ski pole.

BACKGROUND OF THE INVENTION

Snow ski areas provide their customers with "ski area trail maps." These guide maps portray an overview of the ski area in drawing form. The maps normally depict the mountain or mountains comprising the ski area in outline form. Upon this outline is displayed various information. For example, the ski runs, or paths, which the skier may take are illustrated on the mountain outline. The ski lifts are also shown on the map. Other information, such as the level of difficulty of each run and the elevation at various points, is given. Further, information is given as to the various services, such as food, restrooms, warming huts and the like, and the location of the same at the ski area. A skier who is unfamiliar with a ski area relies heavily upon the information contained on these ski area trail maps. This information allows the skier to guide him or herself through the various runs to the base of the mountain and to the various lift and services. More importantly, the maps aid in providing skiers with information regarding the difficulty of the various runs, enabling the skier to chose runs which are within the level of their skiing ability, thus protecting them from injury.

The ski areas normally provide the trail maps in two forms. In one form, the maps are enlarged and stationed as "signs" at various locations around the ski area. These signs may be several feet wide and several feet tall. While these maps are large and easy to read, they have the disadvantage that in order to use them, they must first be located. Often a skier must ski out of a desired path in order to locate such a map. Further, because of the distance between the map signs, it is often the case that a skier becomes lost or otherwise misguided, and is in need of direction, before another map sign may be located.

Therefore, ski areas also offer ski area trail maps in individual sheet form to each skier. The maps are normally condensed into a size of about 16–20 inches in width by 10–20 inches in height (40–50 cm). The sheets typically have the ski area map on one side, along with advertisements or other information, and often have photos and various other information on the other side. The maps are prefolded so that they may be condensed to a size of about 4 inches (10 cm) by 4 inches (10 cm). In this form, the maps are easily transported by an individual skier in a pocket.

The individual maps are advantageous as they allow an individual skier to use them at any time and at any location. This permits, for example, the skier to plot out runs while riding the ski lift, or to stop at any location while skiing, in order to ascertain current location and/or plot a new course. However, these smaller folded maps also have certain disadvantages. Thus, in order to access and view the map, the map must normally be retrieved from a pocket by the skier and then unfolded for use. The map must then be refolded for storage. Often times, this process occurs while the user is riding a ski lift. To examine the map, the skier may have to stow his or her poles, and then remove one or more gloves in order to access the map from a pocket. This process often leads to a pole, glove, or other item being dropped by the skier from the lift into the snow below. Even if stopped on a run, a skier typically must remove one or more gloves and set poles down to access the map. Once accessed, the map, because it is made of paper, is often difficult to hold onto, especially when it is windy. The map may also quickly become water stained when unfolded and exposed to snow or sleet.

SUMMARY OF THE INVENTION

In accordance with one aspect of the present invention, there is provided a ski pole trail map holder that advantageously allows a skier to selectively view a ski area trail map with ease and convenience. The holder of the present invention allows a skier to store an unfolded map on or in a ski pole, dispensing with the need to fold and unfold maps for retrieval or storage in a pocket. Further, the holder of the present invention allows a user to quickly extend an already unfolded ski area trail map into a viewing position, and when done viewing, retract the map back into its protected, stored position. The mounting of the map to the ski pole provides a convenient location for storage and viewing of the ski area trail map, allowing a skier to access the map without the need to store his or her gloves or poles.

In one embodiment, the invention is a self contained tubular unit which is attached to the outside surface of a ski pole. In this form, the holder includes an outer tubular housing containing an inner spring roller mechanism. A ski area trial map is attached to the spring roller mechanism, allowing the ski area trail map to be rolled or unrolled from the roller through a longitudinal slot in the housing. The roller is spring biased so that the roller is resiliently urged in a direction in which the map connected thereto is rolled onto it.

The tubular map holder is connected to the outside of the ski pole with adjustable clamps. The clamps allow a skier to position the map holder in any position and at any point along the length of the ski pole, thus allowing the user to conveniently customize the position of the holder. Advantageously, the ends of the housing and the clamps are low in profile shaped to mate with the outside surface of the ski pole, in order that the holder may conform to the outside of the pole smoothly and without protrusions.

Preferably, the map is contained in a map cover which protects the map from the elements, as well as stations the map for easy viewing. The map cover is attached at one end to the roller, and extends out of the tubular housing through the longitudinal slot. The map cover includes two sheets of transparent, water resistant material, between which the ski area trail map may be inserted. The map cover thus protects the map from the elements, reducing the likelihood that the map may become water stained and unreadable.

Advantageously, the map cover allows a skier to securely station a ski area trail map holder therein, and yet allows a skier to easily remove and replace a given ski area trail map. This feature is accomplished by a novel flap arrangement on the end of the map cover which extends from the housing. The flap arrangement allows the skier to releasably secure the two ends of the transparent sheets. Further, a small amount of reusable adhesive material located on the inside of the sheets near their connection with the roller aids in securely stationing the map. The secure stationing of the map insures that the map remains flat and easy to view when extended. Further, the cover aids in lessening the effect of wind upon the map when it is being viewed.

A handle is provided on the end of the map cover which extends from the housing. The handle allows a skier to easily grasp the map cover and map contained therein, and extend the map from the housing into a viewing position. This handle also serves to seal the slot through which the map is extended when the map is in its retracted position. Therefore, the handle prevents the entry of foreign material, such as snow, into the housing when the map is not being viewed. The handle is also designed so that the user need not remove his or her gloves in order to access the map, eliminating the worry that one or more gloves may be dropped and lost when an attempt is made to view the ski area trail map.

A lock is provided to allow the user to secure the position of the spring roller and map connected thereto. The lock is arranged such that the user may manually extend the map into a viewing position, and then easily secure the map in this position. This allows the user to ungrasp the handle when the map is in its viewing position, freeing the skiers hands. Further, a map may easily be replaced when the cover is in this extended, locked position.

In a second embodiment, the ski pole itself acts as the outer tubular housing, and the spring roller is mounted directly inside the ski pole itself. A longitudinal slot is placed in the pole to allow the extension of the ski area trail map as described above. The handle, lock, and map cover are all as described above. This embodiment has the added advantage, however, of eliminating the mounting of a separate housing on the outside of the ski pole, keeping the ski pole in its single sleek form.

In either form of the invention, the map holder weighs less than about 7 ounces. In this manner, the holder does not have a noticeable effect on the ski pole onto or in which it is mounted.

Further objects, features and advantages of the present invention will become apparent from the detailed description of the drawings which follows, when considered with the attached figures.

BRIEF DESCRIPTION OF THE DRAWINGS

FIG. 1 is a perspective view of one embodiment of the map holder of the present invention attached to a ski pole.

FIG. 2 is a perspective view of the map holder in FIG. 1 with the map extended for viewing.

DETAILED DESCRIPTION OF THE ILLUSTRATED EMBODIMENT

Figure 3:
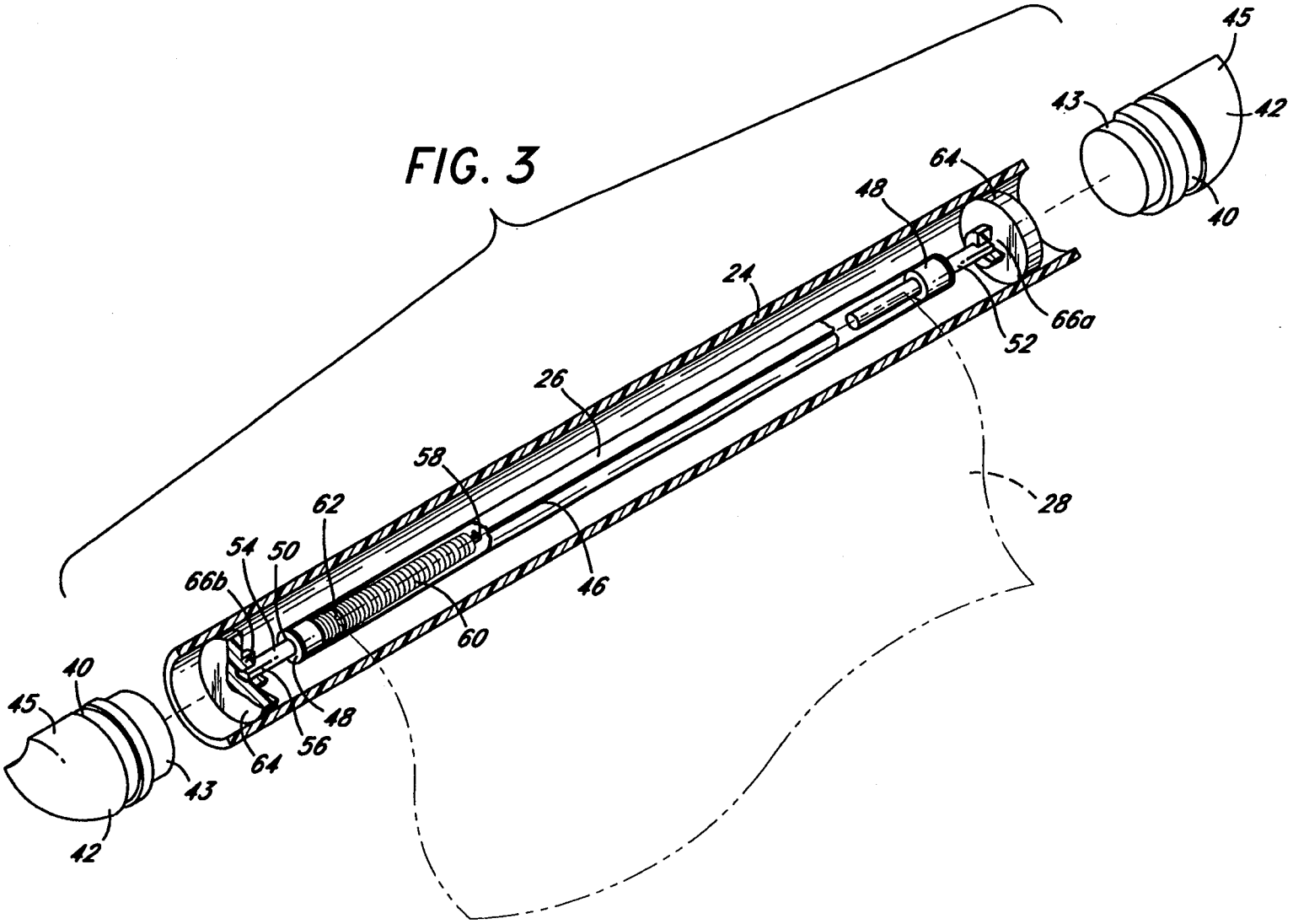
FIG. 3 is an enlarged exploded cross-sectional view of the roller assembly and map housing.

Referring to FIGS. 1 and 2, there is shown one embodiment of a map holder 22 of the present invention mounted to a ski pole 20. In general, the map holder 22 comprises an outer housing 24, containing an inner roller 26 and a map cover 28 for containing a ski area trail map 82 therein.

As illustrated in FIGS. 1 and 2, the map holder 22 comprises a tubular housing 24 for containing the map 82, the map holder 22 being attached to the outside of the ski pole 20. The map holder 22 of the present invention permits an unfolded ski area trail map 82 to be conveniently stored on a ski pole (FIG. 1). The map holder 22 also allows a skier to easily extend the ski area trail map 82 from the housing 24 through a slot 30 therein into a viewing position (FIG. 2).

The map 82 is protected by the water resistant, transparent map cover 28 when extended from the housing 24 for viewing, and by the map cover 28 and housing 24 when stored. The map cover 28 not only protects the map 82, but also secures the map 82 for viewing, preventing interference during viewing by wind and the like. A handle 90 is connected to the map holder 28 and allows a user to easily grasp the map cover 28 so as to extend the map 82 from within the housing 24 to a point outside thereof for viewing.

As now described in more detail, and as illustrated in FIG. 2, the outer housing 24 is an annular member which is preferably smooth on its outer surface, and as such, is preferably a circular tube. The housing 24 is about 12 inches (30 cm) long, although the length may, of course, be longer or shorter depending on the particular pole 20 it is to be used with, and depending on the size of the map 82 to be housed. The inner diameter of the housing 24 is about 1.5 inches (3.4 cm), although the inner diameter may vary depending on the size of the map 82 which is desired to be housed and the map cover 28 material.

It is preferred that the housing 24 be made of plastic, formed by injection molding or other methods. Plastic is preferred, since it retains strength and rigidity over a wide range of temperatures, and will not dent or crush in a fall, as metal might. Further, plastic is lightweight, corrosion resistant, and may be formed in a variety of preselected colors. Although plastic is preferred, other materials having the necessary qualities stated above, are also suitable.

A slot 30 extends longitudinally nearly from end to end along the housing 24. The slot 30, as will be described in more detail below, allows passage of the map 82 in the map cover 28, out of the housing 24. As illustrated, the slot 30 is approximately 0.25 inches (6 mm) in width, although the slot may be wider or narrower, depending on the map cover 28 material which is used. It is preferred that the slot 30 be as narrow as possible while still allowing proper functioning of the device, so as to minimize the area through which snow or other foreign matter may enter the outer housing 24.

The housing 24 is, as illustrated in FIG. 1, removably attached to the outside of the ski pole 20. Two screw clamps 32 secure the housing 24 to the pole 20. The screw clamps 32 are bands 34 which form loops and interlock onto themselves, and may be tightened through the use of screws which engage small ratchets in the bands. It is preferred that the clamps 32 be low in profile so as not to protrude from the housing 24 or pole 20 and cause injury. To facilitate such, a narrow notch 40 is formed into the outside of the housing 24 to allow each band 34 to rest therein. Further, the screw which is used to tighten and loosen the clamps 32 are placed inside a smooth cover (not shown).

The clamps 32 allow the skier to attach or detach the map holder 22 from the ski pole 20. In the illustrated embodiment, this may be accomplished with only a screw driver. Alternatively, the housing 24 may be attached to the ski pole 20 by welding, a pin and slot arrangement, screws or other means known to those skilled in the art.

As shown in FIGS. 2 and 3, caps 42 enclose the ends of the outer housing 24. The caps 42, as illustrated, are made of the same type of plastic as the housing 24 so as to be corrosion resistant and rigid. The caps 42 have an insertion section 43 which is formed to be securely inserted into an end of the housing 24, and an outer section 45 which protrudes therefrom. The insertion section 43 is thus of a slightly smaller diameter than the inside diameter of the housing 24, and has a very short length. The outer section 45 may be of any shape, such as cylindrical or oval; however, it is preferred that outer section have a shape which conforms to the ski pole 20. Therefore, the caps 42, as shown, have an outer section 45 which is conical and has an arcuate cut-away. This cap 42 design eliminates sharp housing 24 and cap 42 edges to protect the skier. While it is possible to have the caps 42 primarily flush with the end surfaces of the housing 24, this is not desirable, as this leaves sharp exposed drop-offs on the ends of the housing 24.

The inner roller 26 is positioned within the outer housing 24. As seen in FIG. 3, the inner roller 26 is a cylindrical tube having a thin slot 46 extending longitudinally therethrough. The roller 26, as illustrated, is about 11.5 inches (29 cm) long. The roller 26 is long enough to hold the map cover 28 and map 82, and yet still fit within the outer housing 24. The inner roller 26 may be of other sizes, however, depending on the size of the map cover 28 and size of the housing 24 with which it is to be used. The outer diameter of the roller 26 is about 0.5 inches (10.5 mm). The small outer diameter of the roller 26 allows maximum rolling space between the roller 26 and the inside of the housing 24, and yet provides a rolling surface which is large enough to provide smooth rolling of materials thereon. The roller 26 may be made of any material which is strong and corrosion resistant, such as aluminum or plastic.

A plug 48 is placed in each end of the roller 26. The plugs 48 are plastic tabs which enclose the ends of the roller 26. Each plug 48 has a small bore 50 therethrough to allow the introduction of first and second shafts 52, 54.

The first shaft 52 is cylindrical, being about 2 inches (5 cm) long and about 0.15 inches (3.7 mm) in diameter. The first shaft 52 extends from inside the roller 26, through the bore 50 in the plug 48, to a point about 0.5 inches (1 cm) outside of the roller 26. The second shaft 54 at the other end of the roller 26 is primarily cylindrical, having a length of about 7 inches (17.5 cm), and a diameter of about 0.15 inches (3.7 mm). The second shaft 54, however, has a flat engaging end 56 and a slotted end 58. The second shaft 54 extends from the slotted end 58 located inside the roller 26, through the bore 50 in the plug 48, and outside of the roller 26 to the engaging end 56. The engaging end 56 is rectangular in shape and extends along the shaft 54 just at the very end. It is possible, of course, to mount the roller 26 upon only one shaft extending through both plugs 48. However, to reduce the weight of the map holder 22, as well as keep material costs low, two short shafts 52, 54 are desired.

A spring 60 is mounted on the second shaft 54. The spring 60 is connected at one of its ends to the shaft 54, and at its other end to the plug 48. As illustrated, the spring 60 is attached to the shaft 54 by pinching one free end of the spring 60 in the slot 58 in the shaft 54. The other free end of the spring 60 engages a small detent 62 in the plug 48 inside the roller 26. The spring 60, as shown, is about 5 inches (12.5 cm) long and provides a force sufficient to retract the map 82 and map cover 28 into the roller 26. While the spring 60 and roller 26 described above form a spring roller mechanism which works well in retracting the map 82, there are other means by which the roller 26 could be resiliently rotated. For example, the spring 60 could be attached to the outside end of the roller 26. The spring 60 could also be connected so as to stretch instead of wind, like through use of a resilent material positioned so as to be coiled about the roller 26 as it turns, as is apparent to one skilled in the art.

Two discs 64 are mounted inside the housing 24 very near the ends of the housing. The discs 64 are thin circular members which are secured to the inside of the housing 24. Each disc 64 has a mounting hole 66*a,b* at its center.

The end of the first shaft 52 extending from the roller 26 engages one mounting hole 66*a*. This mounting hole 66*a* is circular, so as to allow the cylindrical first shaft 52 to free-wheel therein. The other mounting hole 66*b* is rectangular so that the engaging end 56 of the second shaft 54, when inserted into the hole 66*b*, is prevented from rotating.

Alternatively, the mounting holes 66*a,b* may be formed into the inside of the insertion end 43 of the end caps 42. In this case, no discs 64 are necessary. The holes 66*a,b* are, in this alternate instance, located in the center of the insertion section 43 of the caps 42. This feature is advantageous as it allows access to, and removal of, the internal roller 26 mechanism merely by removing one of the caps 42. However, this embodiment has the disadvantage of having one less seal (the disc 64) to protect the inside of the housing 24 from foreign element.

As will now be apparent from the above description, the mounting of the roller 26 inside the housing 24 allows the roller to rotate as impeded only by the spring 60. The spring 60, as positioned, biases the roller 26 to a non-rotated position.

Figure 7:
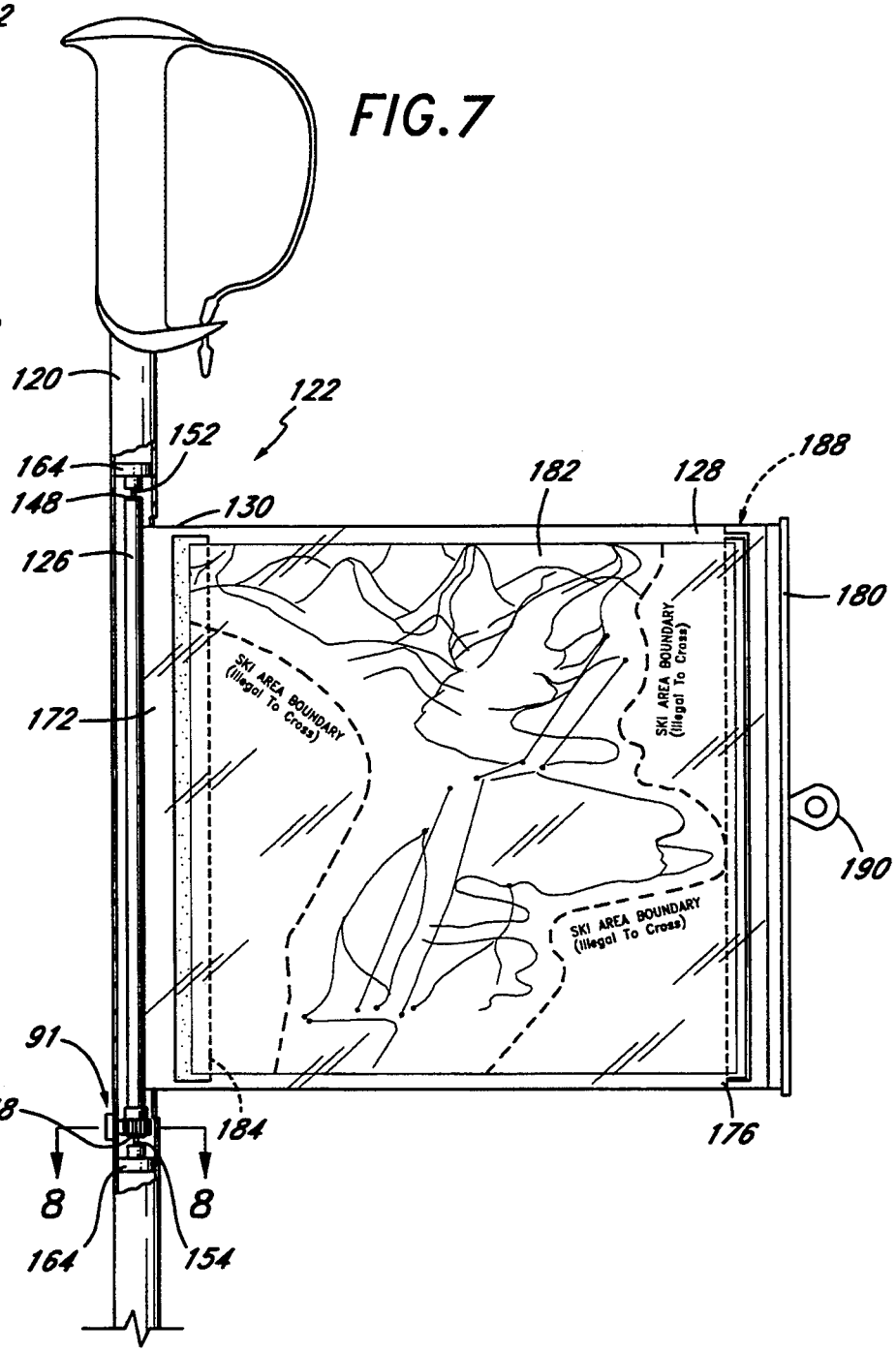
FIG. 7 is a partial cut-away view of the map holder in FIG. 6.
Figure 8:
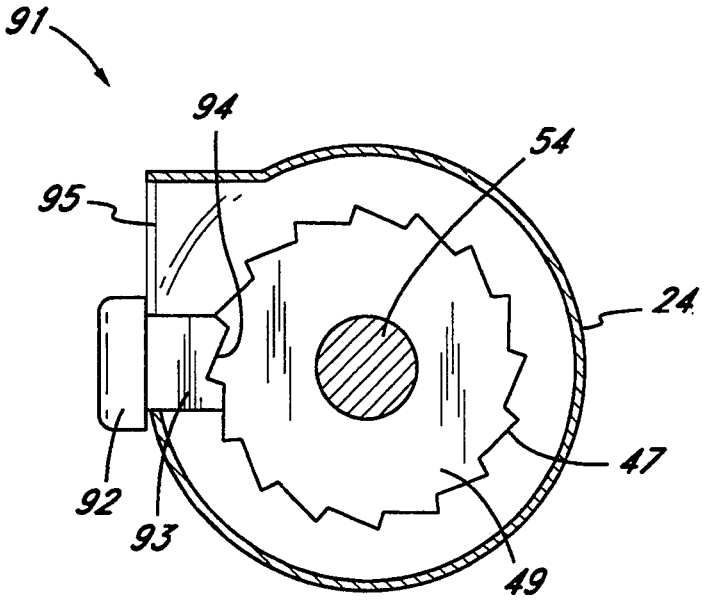
FIG. 8 is a cross-sectional view of the map holder taken along line 8—8 of FIG. 7, illustrating the lock in its locked position.
Figure 9:
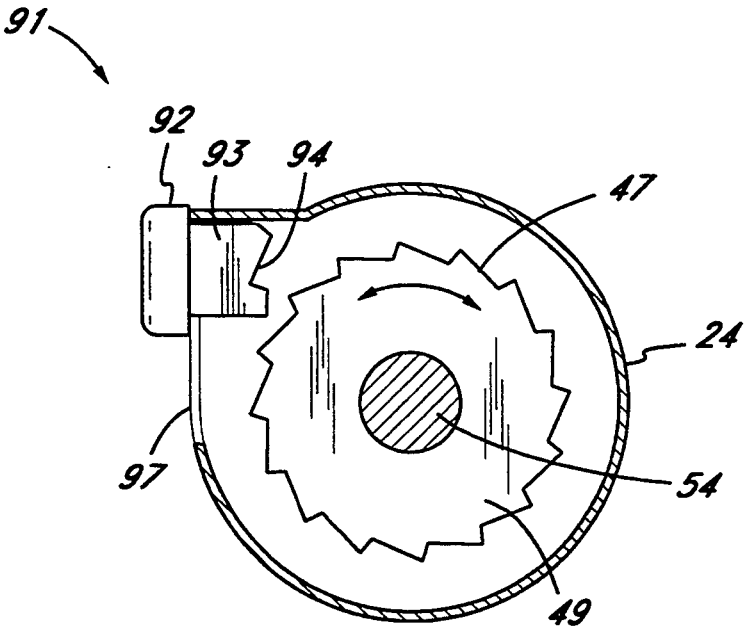
FIG. 9 is a cross-sectional view of the map holder taken along line 8—8 of FIG. 7, illustrating the lock in its unlocked position.

In conjunction with FIG. 7 and as illustrated more clearly in FIGS. 8 and 9, there is illustrated a preferred inner roller mechanism which includes a lock 91. The lock 91 comprises a slider 92 connected to an engaging ratchet 93, and a gear 49 connected to the inner roller 26.

The gear 49 is, as shown, circular and formed as part of one of the plugs 48 located in one of the ends of the inner roller 26. The gear 49 has a number of engaging teeth 47 located about its outer surface.

The slider 92 is a small square button shaped for easy manipulation by a finger or thumb of a user. The slider 92 is located on the outside surface of the housing 24 (this is illustrated in FIG. 7 in conjunction with the lock 91 on the second embodiment, described below). A tab (not shown) protrudes from the side of the slider 92 facing the housing 24.

The ratchet 93 is a primarily thin rectangular block having teeth 94 on one face. The ratchet 93 is located on the inside of the outer housing 24.

A short longitudinal slot 95 is formed in the outer housing 24. A screw (not shown) is placed in the slider 92, and passes through the slot 95 and engages the ratchet 93 so as to fix the slider 92 and ratchet 93 to one another. The slot 95 is long enough to allow the slider 92 and ratchet 93 to travel a short distance which, as described below, locks and unlocks the roller 26.

A flat ledge 97 is formed into the housing 24 surrounding the slot 95. In this fashion, the slider 92 and ratchet 93 may more easily travel in the slot 95. Two indentations (not shown) are located in the ledge 97 to accept the tabs in the slider 92 when the slider is at various locations along the slot 95.

The slider 92 and ratchet 93 are positioned on a point on the housing 24 such that the ratchet 93 may be moved into a position where it engages the gear 49 on the plug 48. The indentations on the ledge 97 are positioned such that the slider 92 is securely stationed by engagement with the tab in two positions: one corresponding to when the lock is unlocked, and one corresponding to a locked position.

It is noted that if the inner roller 26 is mounted directly to the end caps 42 and not to discs 64 located inside the housing 24, then the slider 92 and ledge 97 will be positioned on one of the caps 42 instead of along the housing 22. The gear 49 and rachet 93 are positioned as described above, as would be apparent to one skilled in the art.

The operation of the lock 91 will now be described in conjunction with FIGS. 8 and 9. As illustrated in FIG. 9, the slider 92 is normally in a position corresponding to that where the ratchet 93 is not engaging the gear 49. This position is maintained by the tab and indentation arrangement. When the slider 92 is in this position, the inner roller 26 may rotate freely, allowing the map 82 and map cover 28 to be extended and retracted.

When the map 82 is to be removed or replaced, or it is otherwise desired to fix the map 82 for viewing, the inner roller 26 is locked into position. This is accomplished by moving the slider 92 along the slot 95 until the ratchet 96 engages gear 49. When the slider 92 moves into a position where the tab engages the second indentation in ledge 97, the ratchet 93 and gear 49 securely engage one another. Until the slider 92 is pushed out of this position, the inner roller 26 is prevented from rotating. This is the locked position best illustrated by FIG. 8.

Figure 4:
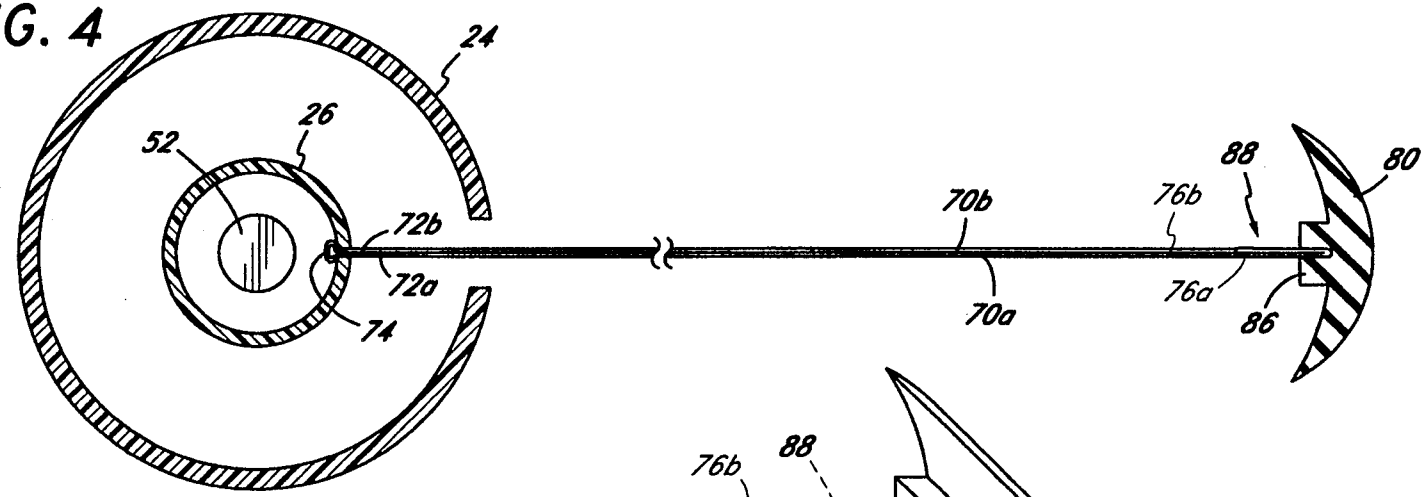
FIG. 4 is a cross-sectional view of the map holder taken along line 4—4 of FIG. 2.
Figure 4A:
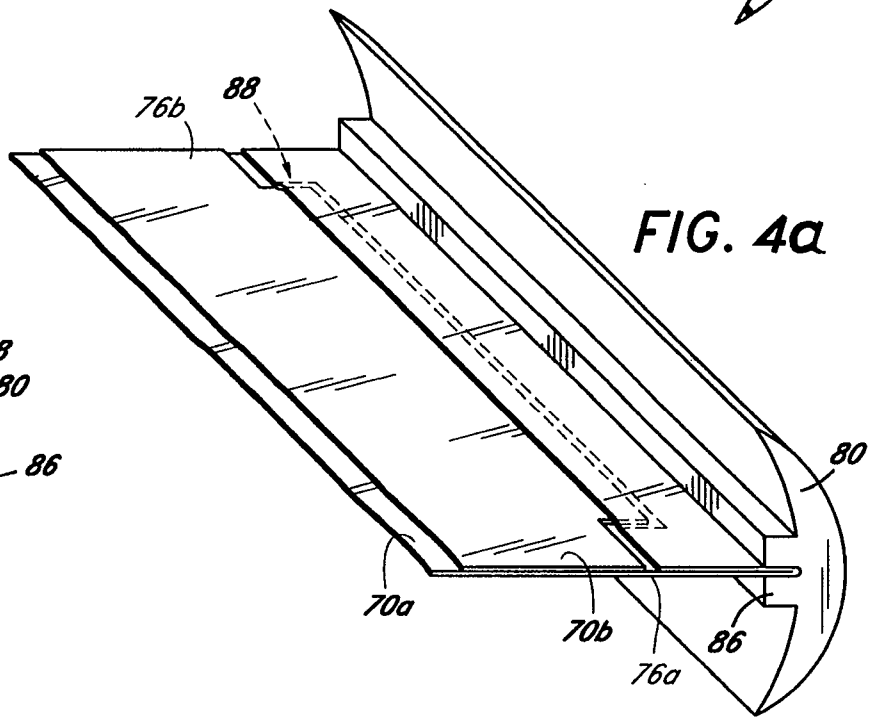
FIG. 4*a* is an enlarged perspective view of the free end of the map cover in its extended position.
Figure 5:
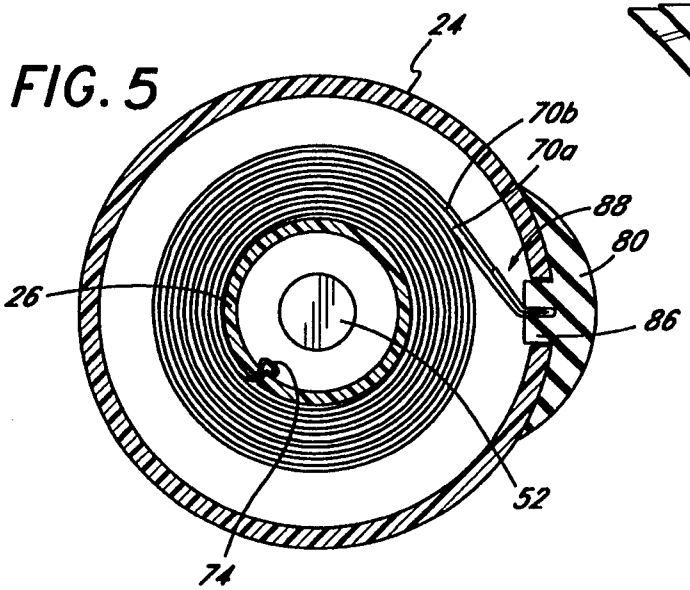
FIG. 5 is a cross-sectional view of the map holder with the map retracted.

Referring now to FIGS. 4, 4*a* and 5, the map cover 28 comprises two sheets 70*a,b* of transparent, water-proof, durable, flexible material. As illustrated, the sheets 70*a,b* are made from polyvinylchloride. This material is chosen because it has the above desired qualities and remains flexible at temperatures as low as −40 degrees F. Other materials, such as polyethylene or polypropylene may be used, as they are durable in cold weather; however, these materials are somewhat less flexible and so do not roll up as easily.

The sheets 70*a,b* are each about 16 inches (40 cm) long and 9 inches (23 cm) tall, and about 0.1 inches (0.23 mm) in thickness. The exact dimensions of the sheets 70*a,b* are primarily a function of the size of the map 82 which is to be contained therein. Map cover 28 lengths over 24 inches (60 cm) and heights of 20 inches (50 cm) are contemplated. The above dimensions are preferable as the cover 28 is large enough to house most ski trail maps 82, and yet is not so large that the overall size of the map holder 22 becomes cumbersome.

The sheets 70*a,b* are bound together at attached ends 72*a,b*. This is accomplished, as illustrated, by heat sealing the attached ends 72*a,b* of the sheets 70*a,b*. The heat sealing creates a tab 74 where the ends 72*a,b* meet. It is, of course, possible to form the map cover 28 from one sheet where this single sheet is folded so as to form two sheets. The point at which a single sheet is folded may then be bonded or formed so as to create the tab 74.

Each of the sheets 70*a,b* has a free end 76*a,b* which is located outside of the housing 24. One sheet 70*b* has a free end 76*b* which is slightly tapered on its top and bottom so that its height is somewhat less at this free end than throughout the rest of the length of the sheet (FIG. 4*a*).

The other sheet 70*a* has a free end 76*a* which has a flap 88 and a clam shell cover 80 attached thereto (FIG. 4*a*). The flap 88 is a pocket formed onto the free end 76*a* of the sheet 70*a*. The flap 88 is, as illustrated, 2 to 3 inches (5 to 8 cm) in width, and is as tall as the sheet 70*a*. The flap 88 is formed by folding over the free end 76*a* of the sheet 70*a* and then heat sealing or gluing the top and bottom of the folded area together. The fold area is then bonded to the clam shell cover 80, leaving the edge of the flap 88 which faces towards the housing 24 open. It is possible, of course, to form the flap 88 from a separate piece of material, as would be apparent to one skilled in the art.

The flap 88 is sized to permit the insertion of the tapered free end 76*b* of the other sheet 70*b* therein. In this manner, the free end 76*a* of sheet 70*a* securely engages the free end 76*b* of sheet 70*b*. At the same time, the flap 88 arrangement allows the sheets 70*a,b* to crawl with respect to one another, as will be more fully described below.

The cover 80 attached to sheet 70*a* is a thick, primarily C-shaped or clam shell shaped member having a flange 86 and handle 90. The cover 80 is preferably at least as long as the longitudinal slot 30. The flange 86 is located near the center of the cover 80 on the side of the cover 80 which faces the housing 24. The flange extends the full length of the cover 80. The flange 86, as illustrated in FIG. 5, is sized to fit within the slot 30.

The handle 90 is a flexible tab-like member which extends from the midpoint of the cover 80. The handle 90 is preferably made from a durable flexible material easily grabbed onto, such as leather or a mesh nylon fabric. The handle 90 is sized to permit a skier to easily grab onto it so as to pull the cover 80 from the housing 24.

The map cover 28 is attached to the roller 26 inside of the housing 24. The tab 74 at the attached ends 72*a,b* of the sheets 70*a,b* of the cover is positioned inside the roller 26, with the sheets 70*a,b* extending therefrom. As can be seen, the slot 46 in the roller 26 is sized (0.6–0.7 mm width) so that the tab 74 can not pull therethrough. The map cover 28 could be attached to the roller 26 in any of a number of other means known to those skilled in the art, such as by gluing or riveting.

The sheets 70*a,b* of the map cover 28 extend from the roller 26 out of the slot 30 in the outer housing 24. The sheets 70*a,b* are prevented from recoiling through the slot 30 to the inside of the housing 24 by the cover 80 on sheet 70*b*. In this fashion, the free ends 76*a,b* of the sheets 70*a,b* are always freely accessible.

As illustrated in FIGS. 1 and 4, a map 82 may be positioned inside the map cover 28 between the two sheets 70*a,b* thereof. One or more strips of adhesive 84 are located on the sides of the sheets 70*a,b* which face one another. As shown, the strip of adhesive 84 is located near the attached ends 72*a,b* of the sheets 70*a,b*, extending the full height of the sheets 70*a,b* and being about 3 inches (7.5 cm) in width. This adhesive 84 is of a type which allows repeated engagement and disengagement of material without serious degradation of the adhesive. The map 82 which is placed in the map cover 28 is stationed securely therein by placing one edge of the map 82 in the area of the adhesive 84, and then pressing the sheets 70*a,b* together.

The map 82 is securely stationed in the map cover 28 so as to permit easy visualization thereof. Further, such placement protects the map from foreign material, especially snow. The map cover 28 is also openable so as to allow the user to interchange maps 82. While the above map cover 28 accomplishes these ends, it is possible to make the entire map cover 28 in the form of a pocket, or alternatively, have the map cover made of two sheets which are releasably securable along all edges.

Alternatively the sheets might be connected by engaging bars (not shown). In this form, one sheet may have a column positioned at its free end. The column may be a shaft which is attached to the free end of the sheet by sliding it inside a loop of material at the free end of the sheet so as to capture the column therein. A recess might be positioned inside of the flange 86 of the cover 80, the recess 88 being large enough to accommodate the column 78 therein. In this fashion, the sheets might be attached to one another by inserting the column on the first sheet into the recess in the second sheet, whereby the sheets would be locked to one another at their free ends.

When the map cover 28 comprises two sheets 70*a,b* of material, however, these sheets must be allowed to move with respect to one another, or "crawl", as the map cover 28 is rolled onto the roller 26. Otherwise, the sheets will buckle and wrinkle. It is preferred, therefore, that the sheets 70*a,b* not be directly attached to one another except very near their attached ends 72*a,b* located near the roller 26. These functions are not easily accomplished with a map cover 28 in the form of a pocket or two sheets releasably secured along all edges. These functions are accomplished by the map cover 28 discussed above, as the tapered free end 76*b* of sheet 70*b* is allowed to move back and forth inside flap 88 on sheet 70*a*, and yet not come loose from the flap 88.

Lastly, the map cover 28 must securely station the map 82 therein. In the embodiment described above, this is accomplished through the use of one or more adhesive strips 84 located near the attached ends 76*a,b* of the sheets 70*a,b*. The two sheet 70*a,b* map cover 28 arrangement with adhesive 84 allows the map 82 to be secured, be easily removed, and allows the sheets 70*a,b* to crawl as they are rolled and unrolled. Lastly, the arrangement described above where in the map is securely attached inside the cover 28 with the adhesive 84 at one end, and by the engagement of the sheets 70*a,b* at their free ends 76*a,b* protects the map 82 from foreign elements.

If it is necessary to further protect the map 82 from foreign elements, the map cover 28 may be made from material which is somewhat statically attracted to itself. For example, the sheets 70*a,b* might be made of a plastic which is attracted to itself, so that the sheets stick to one another. If the attraction is not too great, the sheets 70*a,b* will be forced to crawl so as not to buckle or wrinkle, and yet remain in contact with one another so as to provide a closed map environment.

It is preferred that the ski area map 82 will be placed in the map holder 28 described above. However, it is possible to laminate each map 82 with plastic or other material, and then install the map 82 directly to the inner roller 26 in the holder 22. In this form, the map 82 and its transparent protective covering is a single sheet and is easily rolled or unrolled from the roller 26 when connected thereto. Alternatively, the map 82 could be printed on a clear sheet of water-resistant material, such as plastic, which could be attached to a roller or tube for retraction into a housed position and extension into a viewing position.

The total weight of the map holder 22, as comprised of the above described components, should weigh less than about 10 oz. (285 g); however, it is preferred that the holder 22 weigh no more than about 7 oz. (200 g). As a ski pole 20 typically weighs about 24 oz. (1 Kg), it is therefore preferred that the holder 22 weigh less than about one-third of the weight of the pole 20. In this manner, the added weight of the holder 22 is not noticeably significant. Further, because the added weight is located near the top of the ski pole 20, the added weight is less noticeable. This is because the top of pole 20 is pivoted at the hand of the user. This point is far from the free end of the pole which is swung about freely by the user.

The operation of the map holder 22 will now be described. A user may either buy a ski pole 20 with the holder 22 already attached, or the user may attach the map holder 22 to a ski pole 20 with the clamps 32 him or herself. To self-mount the holder 22, the holder 22 is positioned on the pole 20 at the point most convenient to the user, and the clamp 32 is tightened around the pole 20 and holder 22 with the screws 36.

The pre-folded ski area trail map 82 is unfolded either partially or completely so as to expose the map, and is then positioned inside of the map cover 28. The positioning of the map 82 is accomplished by first extending the map cover 28 from the housing 24. The map cover 28 is pulled from the housing 24 by grabbing the handle 90 on the cover 80 with one or more fingers. The map cover 28 is then fully extended from inside the housing 24.

Once the roller 26 is fully extended, the lock 91 is engaged, as fully described above. The sheets 70*a,b* of the cover 28 are separated by sliding the tapered free end 76*b* of sheet 70*b* out from inside the flap 88 on sheet 70*a*. The map 82 is inserted between the sheets 70*a,b* with one edge of the map located along the adhesive area 84. The sheets 70*a,b* are then pressed together to secure the map 82 securely in the cover 28. The free end 76*b* of sheet 70*b* is then pressed into the flap 88 on sheet 70*a* so that the sheets 70*a,b* engage one another.

The lock 91 is then disengaged as described above, and the cover 28 is allowed to retract into the housing 24 automatically by the spring biased roller 26. The map 82 may then be viewed by the user at any time by extending the map cover 28 from the housing 24.

If it is desired, the lock 91 may be re-engaged when the map 82 is extended for viewing. This allows the user to release his or her grip from handle 90 while viewing the map 82.

Figure 6:
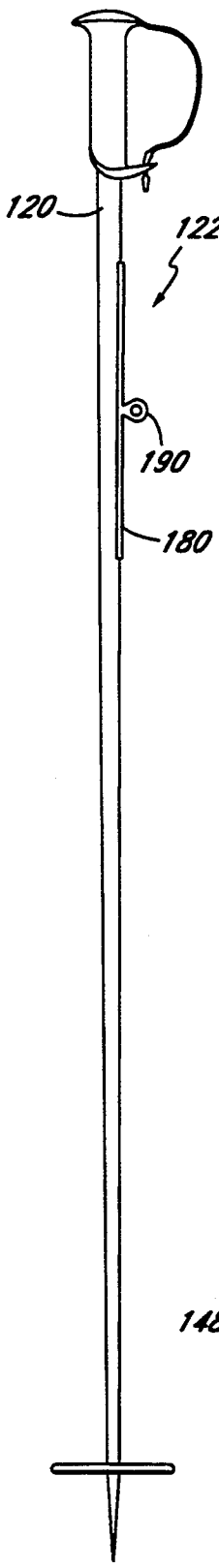
FIG. 6 is a perspective view of an alternate embodiment map holder as mounted within a ski pole.

An alternate embodiment of the map holder 122 is shown in FIGS. 6 and 7. In this embodiment, the map holder 122 comprises the same component parts as the above described embodiment, except that the housing is the ski pole 120 and not a separate outer housing 24 as above.

In this embodiment, the ski pole 120 acts as the housing. Because ski poles 120 typically have an inner diameter of 0.5–1 inch (12–25 mm) near their handles, the pole 120 in which the map 182 is to be housed must be enlarged slightly so that it has an inner diameter large enough to accommodate the roller 126 with the map cover 128 and map 182 rolled thereon. A longitudinal slot 130 is machined out of the pole 120, the slot 130 having dimensions similar to those described above.

Discs 164 are fitted in the pole 120. The discs 164 should be fitted in the pole 120 in a manner so as to prevent the penetration of water of other material past them into the remaining interior portion of the pole 120. This may be accomplished by using a caulking or sealant between the discs 164 and pole 120, or by melting the discs 164 to the pole 120 sides. The discs 164 should have the same type of mounting holes 166*a,b* as those described above.

The discs 164 are mounted in the pole 120 a distance apart so that a spring biased inner roller 126 with shafts 152, 154 and plugs 148 like those above, may be inserted.

It is also preferred that a lock 91, like that described above, be incorporated. The lock 91 is positioned at the end of the inner roller 126, the lock 91 being the same as that illustrated in FIGS. 8 and 9.

A map cover 128 is once again attached on one end 172 to the roller 126, and extends to a free end 176 out of the slot 130 in the pole 120. The free ends 176 of the map cover 128 have the same flap 188 engagement as described before, and a clam shell cover 180 with a handle 190 are again used to seal the slot 130 and provide a gripping surface.

The entire map holder 122 should once again weigh less than 10 oz. (285 g), however, it is again preferable that it not weigh more than about 7 oz. (200 g) so that the added weight is not substantially noticeable. It is noted that if the map 84 is printed directly upon a single water-resistant, durable material, as described above, the weight of the holder 122 may be further reduced.

It is possible that when using larger map covers 128 with a longer slot 130, the pole 120 may need reinforcing ribs or other structures so that the structural integrity is not compromised. It is believed, however, that with smaller slot 130 widths, as contemplated here, the pole 120 integrity will not be compromised.

It will be understood that the above described arrangements of apparatus and the methods therefrom are merely illustrative of applications of the principles of this invention and many other embodiments and modifications may be made without departing from the spirit and scope of the invention as defined in the claims.

What is claimed is:

1. An apparatus for navigating on a ski slope, comprising:

a ski pole having a generally cylindrical shaft with a curved exterior surface;

a generally tubular-shaped housing having a longitudinal axis and two ends, said housing comprising a longitudinal slot therein interposed between a first end cap and a second end cap, each said end cap comprising an arcuate surface having a curvature which substantially matches that of said ski pole shaft,;

a first disc and a second disc mounted inside said housing and positioned apart from each other;

an inner roller having a first end and a second end, said roller being rotatably mounted inside said housing generally along the longitudinal axis thereof, said roller having a surface upon which a map can be rolled;

a first shaft supporting said first end of said roller and connected to said first disc;

a second shaft supporting said second end of said roller and connected to said second disc; and a torsion spring connected to said first shaft and coupled to said inner roller.

2. The apparatus of claim 1, additionally comprising a map and a map cover, said map being located in said cover, one end of said map cover being attached to said roller and the other end of said cover being positioned outside of said housing.

3. The apparatus of claim 1, additionally comprising a map positioned on said roller mechanism.

4. The apparatus of claim 1, wherein said first disc and said first end cap are integrally formed together and said second disc and said second end cap are integrally formed together.

5. A ski area trail map holder for use with a ski pole, comprising:

a generally tubular housing for attachment to the ski pole, said housing having a longitudinal slot therein, said housing being formed of a durable, lightweight material;

at least one connector for attaching said housing to the ski pole;

first and second caps connected to each end of said housing, respectively, each of said first and second caps comprising a groove sized to receive at least a portion of the ski pole, said first and second caps comprising a lightweight material; and a spring roller mechanism rotatably mounted in said housing, said spring roller mechanism comprising a lightweight roller having first and second ends, and a biasing member coupled to said roller, said biasing member having a longitudinal length less than that of said roller, said spring roller mechanism further comprising first and second shafts which support said first and second ends of said roller, respectively, the sum of the lengths of said first and second shafts being less than the length of said roller;

said tubular housing, caps and spring roller mechanism having a combined weight of less than about ten ounces.

6. The trail map holder of claim 5, wherein said roller is rotatably mounted on said shafts.

7. The trail map holder of claim 5, wherein one end of one of said shafts is prevented from rotating with respect to said roller.

8. The trail map holder of claim 5, additionally comprising a map cover for housing a ski area trail map, said map cover comprising two sheets, said sheets joined at one end at a connection with said roller and having free ends which extend out of said housing through said slot.

9. The ski area trail map holder of claim 5, additionally comprising a map positioned on said roller mechanism.

* * * * *